United States Patent [19]

Brown et al.

[11] 4,125,937

[45] Nov. 21, 1978

[54] APPARATUS FOR HYDRAULICALLY EXPANDING A TUBE

[75] Inventors: Philip S. Brown, Brandon; Douglas G. Harman, Tampa, both of Fla.

[73] Assignee: Westinghouse Electric Corp., Pittsburgh, Pa.

[21] Appl. No.: 810,817

[22] Filed: Jun. 28, 1977

[51] Int. Cl.[2] ..... B23P 15/26

[52] U.S. Cl. ..... 29/727; 29/157.4; 29/421 R; 72/62

[58] Field of Search ..... 29/727, 421 R, 157.3 V, 29/523, 455 R, 157.4; 72/62, 58

[56] References Cited

U.S. PATENT DOCUMENTS

| | | | |
|---|---|---|---|
| 2,460,580 | 2/1949 | Huber | 29/421 R |
| 2,479,702 | 8/1949 | Rood | 29/421 X |
| 3,977,068 | 8/1976 | Krips | 29/727 X |
| 3,979,810 | 9/1976 | Krips | 29/421 R X |

*Primary Examiner*—Victor A. DiPalma

*Attorney, Agent, or Firm*—F. J. Baehr, Jr.

[57] ABSTRACT

A mandrel that forms an annular space when inserted within a tube and has O rings adjacent each end and a leading end having a tapered portion and a spring cooperatively associated with the O ring to facilitate sliding the mandrel into the tube and forming a fluid-tight seal adjacent the leading end of the mandrel so that pressurized fluid can be introduced into the annular space to expand the tube into engagement with a tube sheet.

5 Claims, 1 Drawing Figure

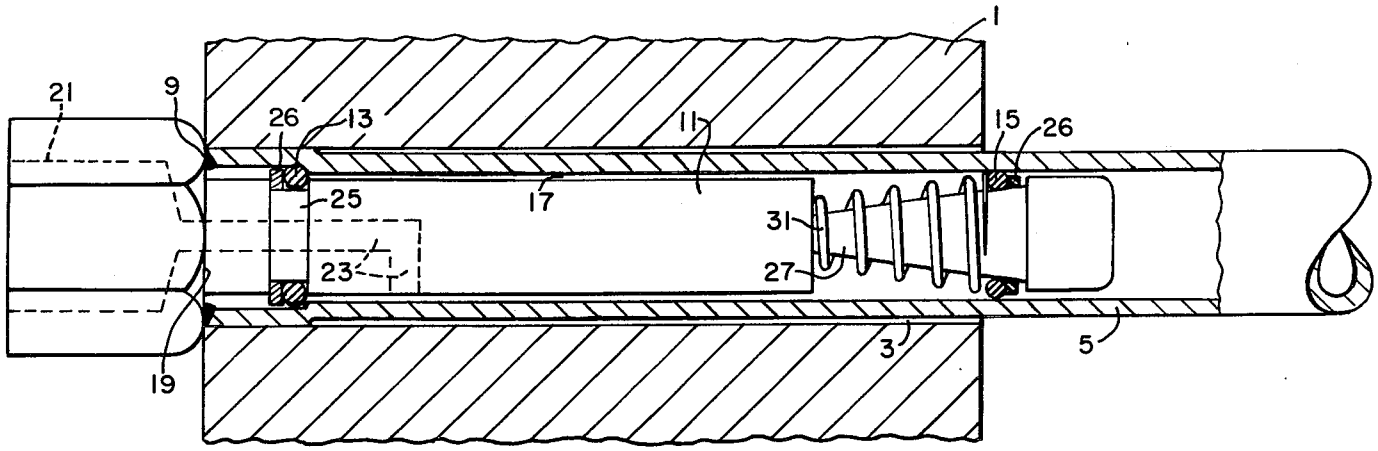
1
26
15
5
3
31
27
11
17
13
25
23
26
9
19
21

APPARATUS FOR HYDRAULICALLY EXPANDING A TUBE

BACKGROUND OF THE INVENTION

This invention relates to tube expanders, and more particularly, to hydraulic tube expanders.

In steam generators and other heat exchangers, expansion of a tube into full engagement with the entire depth of a tube sheet is a difficult task.

Mechanically rolling the tubes the full depth of the tube sheet is time consuming and results in high residual tensile stresses adjacent the transition region and necessitates the utilization of lubricants that require extensive post-cleaning operations in order to remove all residues thereof.

Explosive expansion is noisy, requires close controls and intensive specialized training of personnel and is highly regulated by governmental agencies.

Hydraulic expansion may be easily controlled, performed quickly with a minimum amount of personnel training, and when performed with demineralized water, the necessity for subsequent cleaning operations is practically eliminated; however, providing a satisfactory long-lasting seal adjacent the leading end is difficult as the leading end seal slides along the whole length of the tube within the tube sheet and is easily damaged in the process.

SUMMARY OF THE INVENTION

Apparatus for hydraulically expanding a tube into engagement with a tube sheet, when made in accordance with this invention, comprises a mandrel having an outer diameter smaller than the inner diameter of the tube so as to form an annular cavity between the mandrel and the tube, when the mandrel is inserted in a tube. The mandrel has a fluid inlet port in one end thereof disposed in fluid communication with the annular cavity. The one end of the mandrel has a shoulder which extends radially outwardly beyond the inner diameter of the tube and a circumferential groove adjacent thereto. Disposed in the circumferential groove is a first O ring which forms a fluid-tight seal on one end of the cavity. The mandrel also has a tapered portion adjacent the other end, the tapered portion expanding outwardly as it approaches the other end of the mandrel. A second O ring seal is disposed on the tapered portion and forms a seal adjacent the other end of the cavity. A spring biases the second O ring toward the other end of the mandrel, whereby the mandrel may be easily slipped into the tube without damaging the O ring that first enters the tube and still provide a fluid-tight seal adjacent each end of the annular space.

BRIEF DESCRIPTION OF THE DRAWINGS

The objects and advantages of this invention will become more apparent from reading the following detailed description in connection with the accompanying drawings in which:

The sole FIGURE is a partial sectional view of a tube before it is expanded into engagement with a tube sheet, the tube having a mandrel made in accordance with this invention disposed therein.

DESCRIPTION OF THE PREFERRED EMBODIMENT

Referring now to the drawings in detail, there is shown a tube sheet 1 having a hole 3 extending therethrough and disposed in the hole is a tube 5. One end of the tube 5 terminates adjacent one edge of the tube sheet 1 and a short portion of the tube contiguous with the terminal end is expanded into engagement with the tube sheet by rolling or other means and is welded to the tube sheet 1 to form a seal weld 9 therebetween.

A mandrel 11 is disposed within the tube 5 and has O rings 13 and 15 disposed adjacent each end thereof to form an annular space 17 between the tube 5 and the mandrel 11. The outer diameter of the mandrel 11 is slightly smaller than the inside diameter of the tube 5 before it is expanded.

One end of the mandrel 11, the end adjacent the terminal end of the tube or the end on the left in the drawings, has a shoulder 19 which extends radially outwardly beyond the inner diameter of the tube 5 and forms a stop for the mandrel 11 gauging the depth that the mandrel is inserted in the tube. An inlet port 21 is disposed on the one end and cooperates with a duct 23 to provide fluid communication to the annular space 17 in order to allow pressurized fluid to enter the space 17 and expand the tube 5. A circumferential groove 25 is disposed adjacent the shoulder 19 and cooperates with the O ring 13 and an elastomer backup washer or ring 26 to form a seal between the mandrel and the tube, sealing off one end of the annular space 17.

The mandrel also has a tapered portion 27 disposed adjacent the other end or the leading end of the mandrel, the end shown on the right in the sole FIGURE. The tapered portion 27 expands outwardly toward the leading end of the mandrel 11.

Cooperatively associated with the tapered portion 27 is the O ring 15, the elastomer backup washer or ring 26 and a spring 31, which cooperate to allow the O ring 15 to slide into the tube without utilizing a lubricant and without damaging the O ring 15. The outer diameter of the O ring 15, in its free state, is slightly smaller than the inside diameter of the tube 5. The backup ring 26 is preferably made of Polyurethane or other suitable material and prevents the O ring 15 from blowing by the leading end of the mandrel during pressurization. During the extraction portion of the operation, operating fluid, preferably deionized water acts as a lubricant.

The operation of the mandrel is as follows:

The leading end of the mandrel 11 is inserted into the tube 5. As the O ring 15 contacts the inner surface of the tube 5, it pushes against the spring 31 which yields and allows the O ring 15 to slide down the tapered portion 27 of the mandrel 11. Since the O ring has an outer diameter slightly smaller than the inner diameter of the tube 5 it contracts, frictional pressure between the O ring and the tube is reduced to a minimum value. The O ring 13 only slides a short distance into the tube and thus is not as susceptible to damage as the mandrel 11 is pushed into the tube to a depth that the shoulder 19 abuts the tube sheet 1. Pressurized fluid, preferably deionized water, is supplied to the inlet port 21 and is fed by the duct 23 to the annular space 17 between the tube 5 and the mandrel 11. The high pressure fluid expands the tube plastically deforming the tube material until it yields, producing intimate engagement of the tube 5 and tube sheet 1. After the tube is expanded, the pressurized fluid is released and the mandrel 11 is removed from the tube 5.

The apparatus hereinbefore described advantageously expands the tubes quickly, within well defined limits of applied stresses, and eliminates the need for subsequent cleaning. The apparatus also may be utilized repeatedly without replacement of the O rings as the wear thereon is minimized due to the arrangement of the tapered spring 31 and backup washer 26, which cooperate to minimize the wear on the O ring 15 adjacent the leading end of the mandrel.

We claim:

1. Apparatus for hydraulically expanding a tube into engagement with a tube sheet, said apparatus comprising:

a mandrel having an outer diameter smaller than the inner diameter of said tube so as to form an annular cavity between the tube and the mandrel when the mandrel is inserted in said tube;

said mandrel having a fluid inlet port in one end thereof;

said fluid inlet port being in fluid communication with said annular cavity;

said one end having a shoulder extending radially outwardly beyond the inner diameter of said tube;

a circumferential groove adjacent said one end of said tube for receiving a first sealing means which forms a fluid type seal adjacent said one end of said cavity;

a tapered portion adjacent said other end of said mandrel;

said tapered portion expanding outwardly as it approaches said other end of said mandrel;

a second sealing means disposed on said tapered portion and forming a seal adjacent the other end of said cavity; and means for biasing said second sealing means toward the other end of said mandrel, whereby said mandrel may be easily slipped into said tube without damaging the sealing means which first enters the tube and providing a fluid-tight seal adjacent each end of the annular space.

2. Apparatus as set forth in claim 1, wherein the sealing means are O rings.

3. Apparatus as set forth in claim 1, wherein the second sealing means is an O ring having an outer diameter slightly smaller than the inner diameter of the tube.

4. Apparatus as set forth in claim 1, and further comprising an elastomer washer disposed on the tapered portion of the mandrel adjacent the other end thereof.

5. Apparatus as set forth in claim 1, wherein the means for biasing the second sealing means is a spring.

* * * * *